US005216472A

United States Patent [19]

Muto et al.

[11] Patent Number: 5,216,472

[45] Date of Patent: Jun. 1, 1993

[54] PRINTER WITH PAPER SUPPLYING DEVICE

[75] Inventors: Kiyoshi Muto, Yokkaichi; Haruyuki Shimomura, Nagoya, both of Japan

[73] Assignee: Brother Kogyo Kabushiki Kaisha, Nagoya, Japan

[21] Appl. No.: 718,649

[22] Filed: Jun. 21, 1991

[30] Foreign Application Priority Data

Jul. 23, 1990 [JP] Japan ..... 2-196783

[51] Int. Cl.[5] ..... G03G 15/00

[52] U.S. Cl. ..... 355/313; 355/309

[58] Field of Search ..... 271/9, 265, 110; 355/314, 308, 309, 311, 313, 206, 208

[56] References Cited

U.S. PATENT DOCUMENTS

| | | | |
|---|---|---|---|
| 4,470,689 | 9/1984 | Nomura et al. . | |
| 4,472,049 | 9/1984 | Honma et al. | 271/256 X |
| 4,666,281 | 5/1987 | Miyai et al. | 355/309 X |
| 4,708,455 | 11/1987 | Kubota et al. . | |
| 4,763,163 | 8/1988 | Hamano et al. | 355/313 X |
| 4,778,296 | 10/1988 | Takahashi . | |
| 4,786,920 | 11/1988 | Igarashi | 346/134 |
| 4,871,160 | 10/1989 | Yoshino | 271/9 |
| 4,998,216 | 3/1991 | Hino et al. | 364/519 |
| 5,002,414 | 3/1991 | Kikuchi et al. | 400/625 |
| 5,008,715 | 4/1991 | Imaizumi et al. | 355/313 |
| 5,033,890 | 7/1991 | Niikawa | 271/9 X |
| 5,035,413 | 7/1991 | Yamada et al. | 271/9 |

FOREIGN PATENT DOCUMENTS 0288089 10/1988 European Pat. Off. .

*Primary Examiner*—R. L. Moses
*Assistant Examiner*—T. A. Dang
*Attorney, Agent, or Firm*—Oliff & Berridge

[57] ABSTRACT

A printer with a paper supplying device having a printing section that includes a photosensitive drum for printing on a paper, a manual supplying path for guiding a paper inserted manually, a manual insertion tray for receiving a paper in order to insert the paper into the printing section through the manual supplying path, a manual supplying means for supplying the paper from the insertion member to a printing section through the manual supplying path, an automatic supplying path for guiding a paper inserted automatically, a paper cassette for storing plural papers, an automatic insertion means for supplying a paper from the paper cassette to the printing section through the automatic supplying path, a manual insertion paper detecting sensor for detecting whether or not the paper inserted from the manual insertion tray is in the manual supplying path, an automatic insertion paper detection sensor for detecting whether or not the paper supplied from the paper cassette is in the automatic insertion path, and a LED for informing the operator of the time when the insertion member may receive a following sheet of paper. The LED is activated when no paper is detected by both the manual insertion paper detecting sensor and the automatic insertion paper detection sensor. An automatic insertion controller controls supply of the paper from the paper cassette to the automatic supplying path if there is no paper on the manual insertion tray when the printing of the paper previously inserted from either of the manual insertion tray and the paper cassette has been processed and the LED indicated such to the operator, and a manual insertion controller controls supply of the paper from the manual insertion tray to the manual supplying path if there is a paper on the manual insertion tray when a paper previously inserted from either of the manual insertion tray and the paper cassette has been processed and the paper cassette has been processed and operator informed by means of LED.

16 Claims, 4 Drawing Sheets

Fig.3B

| | |
|---|---|
| S1 | DRIVE MAIN MOTOR |
| S2 | TURN OFF LED |
| S3 | IS PAPER IN MANUAL INSERTION TRAY? |
| S4 | SUPPLY FROM MANUAL INSERTION TRAY |
| S5 | SUPPLY FROM SHEET CASSETTE |
| S6 | PAPER SUPPLIED TO PAPER FEEDING PATH? |
| S7 | START IMAGE FORMING OPERATION |
| S8 | IS PAPER IN PAPER FEEDING PATH? |
| S9 | STOP MANUAL AND AUTOMATIC INSERTION ROLLERS |
| S10 | TURN ON LED |
| S11 | IMAGE FORMING OPERATION TERMINATED? |
| S12 | FOLLOWING PAPER REQUIRED? |
| S13 | STOP MAIN MOTOR |

PRINTER WITH PAPER SUPPLYING DEVICE

BACKGROUND OF THE INVENTION

1. Field of the Invention

The present invention relates to a printer with a paper supplying device for supplying a paper by manual insertion from manual insertion part and by automatic insertion from sheet storage part.

2. Description of Related Art

Conventionally, in a printer including a paper supplying device having both of a manual insertion mechanism and an automatic insertion mechanism, when printing paper, for example an overhead projector (OHP) sheet, was manually inserted for a continuous printing, it was necessary to insert a subsequent sheet after the previously inserted sheet had been completely transported from a printing part to a point where the preceding and subsequent sheets do not overlap. Therefore, the operator determined a time for inserting the subsequent sheet and inserted it into the printer.

However, the time for inserting the subsequent sheet varied with the operator. That is, when the operator inserted the subsequent sheet too rapidly, the subsequent sheet was fed simultaneously with the initial sheet. When the operator was slow inserting the subsequent sheet, a sheet normally of a different type, stored in the sheet cassette, was automatically supplied. Both cases were inconvenient for the operator and increased copying time.

SUMMARY OF THE INVENTION

An object of the present invention is to provide a printer with a paper supplying device with which the operator can manually insert a paper without the operator having to time that insertion when multiple pages are to be printed.

In order to achieve this object, the printer with a paper supplying device of the present invention comprises a first detection means for detecting whether or not the paper supplied by manual insertion is in the paper feeding path, a second detection means for detecting whether or not the paper supplied by automatic insertion is in the paper feeding path, and informing means for informing the operator that the subsequent paper can be inserted when no paper is detected in the feeding path by the first and second detection means.

The informing means of the present invention informs the operator that the subsequent paper can be inserted when the first detection means judges the paper supplied by manual insertion is not in the paper feeding path and the second detection means judges that the paper supplied by automatic insertion is not in the paper feeding path.

According to the printer with a paper supplying device of the present invention including first detection means for detecting whether or not the paper supplied by a manual insertion is in a paper feeding path, second detection means for detecting whether or not the paper supplied by an automatic insertion is in the paper feeding path, and informing means for informing that the following manual insertion paper can be inserted when no paper is detected in the feeding path by the first and second detection means, the operator does not miss the timing of the manual insertion of the paper.

BRIEF DESCRIPTION OF THE DRAWINGS

A preferred embodiment of the present invention will be described in detail with reference to the following figures wherein:

FIG. 3B is a table of labels for the flowchart of FIG. 3A.

DETAILED DESCRIPTION OF THE PREFERRED EMBODIMENT

Referring now to the accompanying drawings, a preferred embodiment of the present invention will be described in detail.

Figure 1:
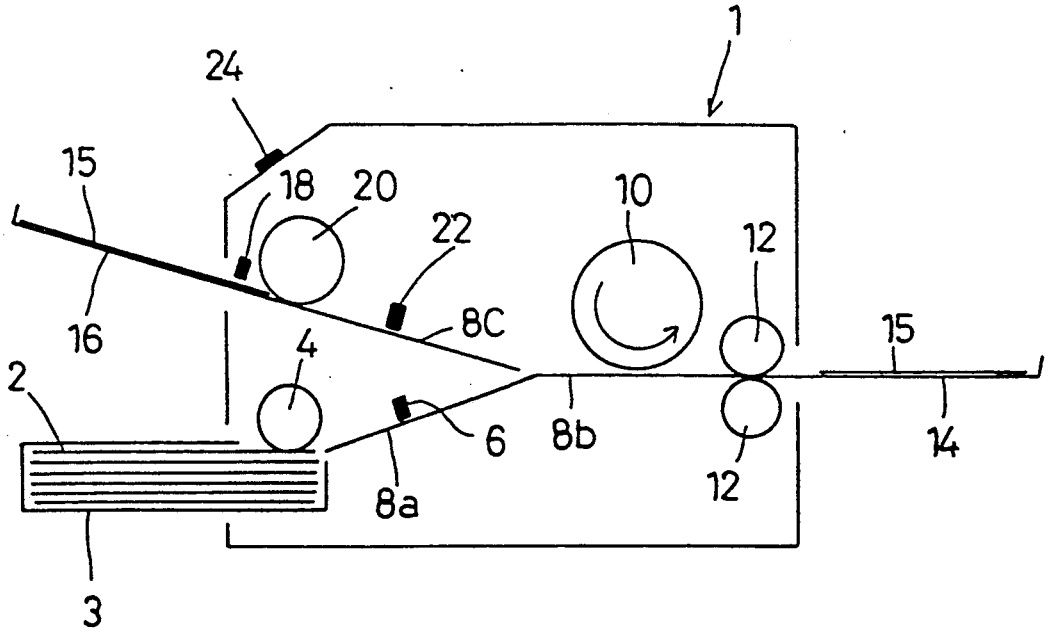
FIG. 1 is a schematic illustration of a laser printer which embodies the present invention.

FIG. 1 is a schematic illustration of a laser printer which is one embodiment of the present invention. A paper cassette 3, which stores a printing paper 2 for automatic insertion, is detachably mounted at a lower position in the laser printer main body 1. The printing paper 2 in the paper cassette 3 is fed into the laser printer main body by an automatic insertion roller 4 installed above the paper cassette 3. As the printing paper 2 is fed into the laser printer main body 1, it passes through paper feeding paths **8*a* and 8*b* to a photo-sensitive drum 10 on which transcript material is formed by a series of printer processes. An automatic insertion paper detecting sensor 6, for detecting whether a printing paper 2 has been automatically inserted into the paper feeding path 8*a*, is installed in the paper feeding path 8*a*. At the photosensitive drum 10, the transcript material is transcribed from the photosensitive drum 10 to the printing paper 2 and the image formed thereon. Then, the printing paper 2, on which the transcript material is transcribed, passes between a pair of fixing rollers 12, and the transcript material is fixed on the printing paper 2 thereby. The printing paper 2, on which the transcript material is fixed, is then discharged from a discharging tray 14 mounted on one side of the laser printer main body 1**.

A manual insertion tray 16 is provided for the manual insertion of a printing paper 15 and is positioned above the paper cassette 3. A manual insertion sensor 18 for detecting whether a printing paper 15 is on the manual insertion tray 16 is installed on the side of the laser printer main body 1 where the manual insertion tray 16 and feed path enter the laser printer main body 1. Printing paper 15 put on the manual insertion tray 16 is moved into the laser printer main body 1 by a manual insertion roller 20 arranged in the laser printer main body 1 over the manual insertion tray 16, where it enters the laser printer main body 1, based on the signal from the manual insertion sensor 18. The printing paper 15 moved into the laser printer main body 1 passes along paper feeding path **8*c*, which joins the paper feeding path 8*b*, to be delivered to the photosensitive drum 10. Moreover, a manual insertion paper detecting sensor 22 for detecting whether a printing paper 15 is in the paper feeding path 8*c* is installed in the paper feeding path 8*c*. The paper sensors 6, 18 and 22** are conventional optical reflecting type sensors having a light emitting part and light receiving part similar to ones disclosed in U.S. Pat. No. 4,778,296 and U.S. patent application Ser. No. 07/185,761, filed Apr. 25, 1988 which corresponds to published European Patent Application No. 288,089.

Further, a LED 24, that indicates when the user can put the subsequent printing paper 15 on the manual insertion tray 16, is installed on an upper side of the laser printer main body 1.

Figure 2:
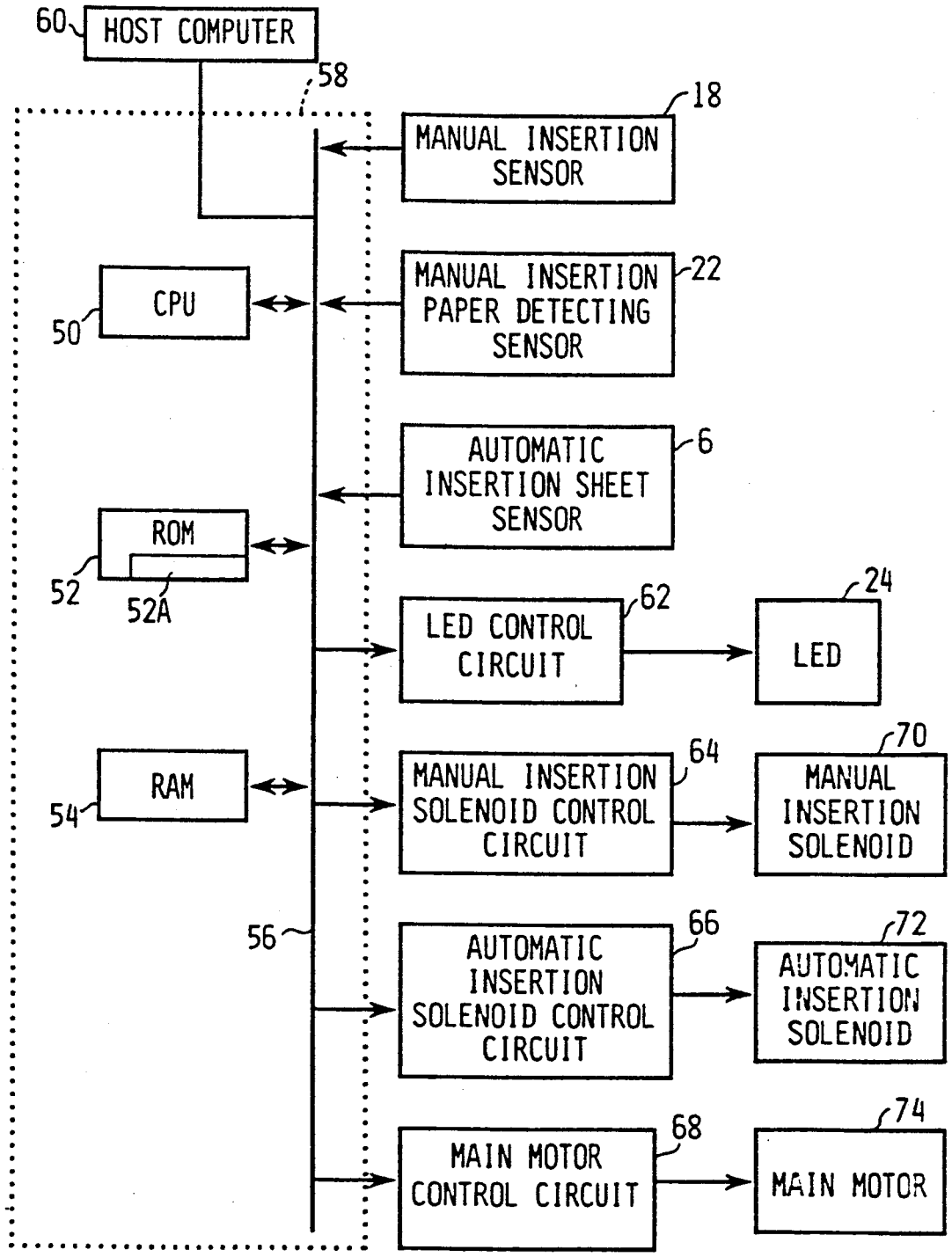
FIG. 2 is a block diagram of the controller.

The controller for the laser printer will be described with reference to FIG. 2.

The controller is a microcomputer 58 which consists of a CPU 50, a ROM 52, a RAM 54 and a bus 56. The ROM 52 includes a program area 52A for storing programs for printing operations. The CPU 50 executes each operation according to the programs stored in program area 52A. The RAM 54 works as a working memory when the CPU 50 executes each operation. When print data is input to the microcomputer 58 from a host computer 60, the printing operations are executed.

The LED 24, a manual insertion solenoid 70, an automatic insertion solenoid 72, and a main motor 74 connect to the microcomputer 58 through a LED control circuit 62, a manual insertion solenoid control circuit 64, an automatic insertion solenoid control circuit 66, and a main motor control circuit 68 respectively. Further, the manual insertion sensor 18, the manual insertion paper detecting sensor 22, and the automatic insertion sheet sensor 6 connect to the microcomputer 58.

The main motor 74 drives the photosensitive drum 10, the fixing rollers 12, the automatic insertion roller 4, and the manual insertion roller 20 through a transmission member. The transmission member, between the main motor and the automatic insertion roller 4 and the manual insertion roller 20, includes clutch members which transfer the rotation power to the automatic insertion roller 4 or the manual insertion roller 20 when the corresponding insertion solenoids 70, 72 are driven. Therefore, the automatic insertion roller 4 is rotated by the main motor 74 only when the automatic insertion solenoid 72 is driven and the manual insertion roller 20 is rotated by the main motor 74 only when the manual insertion solenoid 70 is driven.

Figure 3A:
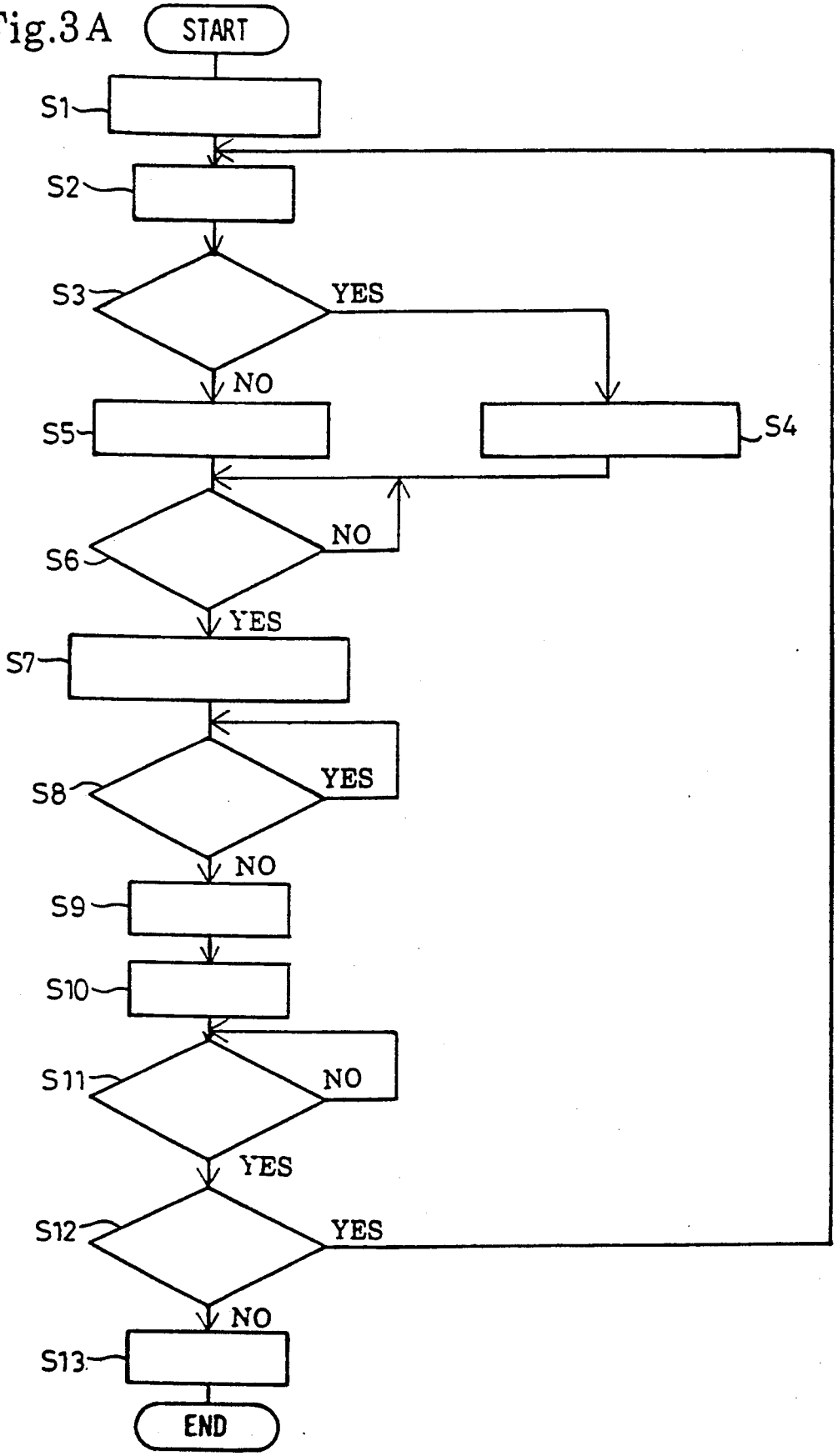
FIG. 3A is a flowchart showing the print processing control of the present invention.

The printing operation in this laser printer will now be explained using the flowchart of FIGS. 3A and 3B.

When print data is input by the host computer 60, the laser printer starts the printing operation. First, the main motor 74 is driven and the photosensitive drum 10 starts to rotate and is kept rotating to obtain a fixed rotation speed. After the rotation speed of the photosensitive drum 10 becomes the fixed, the LED 24 is turned off indicating to the operator that manual insertion of a printing paper is prohibited at that time (S2). Next, the manual insertion sensor 18 judges whether a printing paper 15 is in the manual insertion tray 16 (S3). When it is judged that a printing paper 15 is in the manual insertion tray 16 (S3.YES), the manual insertion solenoid 70 is driven to rotate the manual insertion roller 20 and the manual insertion paper 15 is supplied into the laser printer main body 1 (S4). When it is judged that the printing paper 15 is not in the manual insertion tray 16 (S3.NO), the automatic insertion solenoid 72 is driven to rotate the automatic insertion roller 4 and a printing paper 2 stored in the sheet cassette 3 is supplied in the laser printer main body 1 (S5). Either the manual insertion paper detecting sensor 22 or the automatic insertion paper detecting sensor 6 confirms that a printing paper is supplied to the paper feeding path (S6).

When the predetermined time, that is, the time for the printing paper to reach the photosensitive drum 10, passes, the image forming operation is started (S7). In the image forming operation the photosensitive drum 10 is exposed to a laser beam to form an electrostatic latent image on the photosensitive drum 10 to which toner adheres. The toner image, corresponding to the latent image, is transferred from the photosensitive drum 10 onto the printing paper. This image forming operation is conventional and is the same as the one disclosed in the U.S. Pat. Nos. 4,708,455 and 4,470,689.

Once the image forming operation is started, the manual insertion paper detecting sensor 22 and the automatic insertion paper detecting sensor 6 continue to indicate the presence of the printing paper in the paper feeding path until the printing paper clears the applicable sensor (S8). When the applicable sensor no longer detects a printing paper in the paper feeding path (S8.NO), the manual insertion solenoid 70 or the automatic insertion solenoid 72 is stopped to stop rotating the manual insertion roller 20 or automatic insertion roller 4 (S9). Simultaneously, as both sensors now indicate no paper is present, the LED 24 is turned on which indicates to the operator that it is possible to insert a printing paper 15 in the manual insertion tray 16 (S10). After the present printing processing is terminated (S11), it is judged whether or not the subsequent printing paper is continuously printed (S12). When it is judged that the subsequent printing paper is printed (S12.YES), the flow returns to the S2, the LED 24 is turned off and the subsequent printing paper is supplied.

When it is judged that no printing remains to be done (S12.NO), the main motor 74 is stopped (S13) and the printing operations are terminated.

As mentioned above, the operator has only to insert the printing paper 15 for manual insertion in the manual insertion tray 16 while the LED 24 is turned on, that is, during the time between the feeding of the last printing paper to the paper feeding path and the end of the present print processing. Therefore, the operator should not manually insert the printing paper at an inappropriate time.

Although the present invention has been shown and described in terms of the preferred embodiment thereof, with reference to the drawings, it should not be considered to be limited thereby, since the details of any particular embodiment could be varied without departing from the scope of the invention. For example, the automatic insertion paper detecting sensor 6 and the manual insertion paper detecting sensor 22 may be one and the same and a buzzer or a LCD can be used for the informing means instead of or in addition to the LED 24.

What is claimed is:

1. A printer using a sheet printing medium supplying device comprising:

a printing section for executing a print on a sheet;

a manual supplying path for guiding the sheet inserted manually;

an insertion member for receiving the sheet in order to insert the sheet into the printing section through the manual supplying path;

a manual supplying means for supplying the sheet from the insertion member to the printing section through the manual supplying path;

an automatic supplying path for guiding the sheet inserted automatically;

storage member for storing plural sheets;

an automatic supplying means for supplying the sheet from the storage member to the printing section through the automatic supplying path;

first detection means for detecting whether the sheet inserted from the insertion member is in the manual supplying path;

second detection means for detecting whether the sheet supplied from the storage member is in the automatic supplying path;

information means for informing an operator of a time when the insertion member can receive a subsequent sheet in a case where no sheet is detected by both the first detection means and the second detection means;

automatic supplying controlling means for controlling the automatic supplying means to supply the sheet from the storage member to the automatic supplying path if there is no sheet received on said insertion member following a sheet previously inserted from either of said insertion member and said storage member has been fed more than a predetermined distance away from its inserting point and the operator has been informed by said informing means; and manual supplying controlling means for controlling the manual supplying means to supply the sheet from said insertion member to the manual supplying path if there is a sheet received on said insertion member following a sheet previously inserted from either of said insertion member and said storage member has been fed more than a predetermined distance away from its inserting point.

2. The printer according to claim 1, wherein said predetermined distance is a distance from the inserting point to the printing section.

3. The printer according to claim 1, further comprising:

receiving detection means for detecting whether the sheet is received on said insertion member, and based on a detection of the sheet by said receiving detection means, said manual supplying controlling means controls said manual supplying means and said automatic supplying controlling means controls said automatic supplying means.

4. A printer for printing on a sheet recording medium, comprising:

a manual sheet insertion tray;

a manual sheet feed path;

a manual sheet feed means for feeding the sheet recording medium from said manual insertion tray onto said manual sheet feed path;

a first sensor for detecting the sheet recording medium on said manual sheet feed path;

a sheet cassette for holding a plurality of sheets of recording medium;

an automatic sheet feed means for feeding the sheet recording medium from said sheet cassette onto said automatic sheet feed path;

a second sensor for detecting the sheet recording medium on said automatic sheet feed path;

a spring means for printing on the sheet recording medium, said print means downstream of said first sensor and second sensor;

a signal means for informing an operator when a subsequent sheet recording medium may be placed on said manual sheet insertion tray; and a control means for turning said signal means on when said first sensor and second sensor both indicate no sheet recording medium is present at said first sensor and second sensor and multiple pages are to be printed.

5. A printer as claimed in claim 4, further comprising a third sensor for detecting whether the sheet recording medium is present on said manual sheet insertion tray.

6. A printer as claimed in claim 5, wherein said control means causes said manual sheet feed means to feed said subsequent sheet recording medium when said third sensor indicates said subsequent sheet recording medium is present in said manual insertion tray and said first sensor and second sensor indicate a preceding sheet recording medium has cleared an appropriate one of said first sensor and second sensor.

7. A printer as claimed in claim 6, wherein said control means causes said automatic sheet feed means to feed the subsequent sheet recording medium from said sheet cassette when said third sensor indicates no sheet recording medium is present in said manual insertion tray and said first sensor and second sensor indicate the preceding sheet recording medium has cleared an appropriate one of said first sensor and second sensor.

8. A printer as claimed in claim 4, wherein said signal means is a light emitting diode.

9. A printer as claimed in claim 4 wherein said signal means is a liquid display crystal.

10. A printer as claimed in claim 8, wherein said signal means further comprises a sound emitting device.

11. A printer as claimed in claim 7, wherein said first sensor and second sensor are a single sensor.

12. A printer as claimed in claim 7, wherein a distance between said manual insertion means and said first sensor and between said sheet cassette and said second sensor is a predetermined distance that prevents jamming of the sheet recording medium and the subsequent sheet recording medium.

13. A printer as claimed in claim 7, wherein said first sensor, second sensor and third sensor are optical sensors.

14. A method of manually and automatically feeding sheets to a printer comprising the steps of:

activating a drive motor;

determining if a sheet is present for manual feed;

feeding a manual sheet if present;

feeding an automatic sheet if no manual sheet is present;

checking to determine whether multiple pages are to be printed;

checking to determine if a previously fed sheet has moved a predetermined distance;

turning on an indicator when the previously fed sheet has moved the predetermined distance;

checking whether a subsequent manual sheet to be fed is present;

feeding said subsequent manual sheet when present;

feeding a subsequent automatic sheet if no manual sheet is present;

determining when all pages have been printed; and deacitvating said drive motor.

15. A method as claimed in claim 14, wherein means for determining whether a sheet is present for manual feed is a sensor.

16. A method as claimed in claim 14, wherein said means for determining whether the previously fed sheet has moved the predetermined distance is a sensor.

* * * * *